US006209298B1

(12) United States Patent
Tamoto

(10) Patent No.: US 6,209,298 B1
(45) Date of Patent: Apr. 3, 2001

(54) PROCESS FOR THE MANUFACTURE OF A DIPPED TIRE CORD FABRIC MADE OF ORGANIC FIBER CORDS INCLUDING CORD JOINT PORTIONS

(75) Inventor: Kojiro Tamoto, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/312,474

(22) Filed: May 17, 1999

(30) Foreign Application Priority Data

May 19, 1998 (JP) ..... 10-136371

(51) Int. Cl.[7] ..... D02J 1/08; D02J 1/22; D02G 3/48

(52) U.S. Cl. ..... 57/22; 57/162; 57/238; 57/287; 242/475.5

(58) Field of Search ..... 57/902, 22, 162, 57/238; 264/103

(56) References Cited

U.S. PATENT DOCUMENTS 3,517,425 6/1970 Hunter .
4,002,012 * 1/1977 Norris et al. ..... 57/22
4,389,839 * 6/1983 van der Werff ..... 57/238
4,446,687 * 5/1984 Mima ..... 57/22
4,757,676 7/1988 Clayton .
4,944,821 * 7/1990 Nishikawa et al. ..... 156/161
5,479,769 1/1996 Belloy et al. .

FOREIGN PATENT DOCUMENTS

WO 92 13790 8/1992 (FR) .

OTHER PUBLICATIONS

"Machine ties together tyre cords quickly" Design Engineering, Sep. 1993, XP000394793 Morgan–Grampian Ltd., London GB ISSN: 0308–8448.

* cited by examiner

*Primary Examiner*—John J. Calvert
*Assistant Examiner*—Shaun R Hurley
(74) *Attorney, Agent, or Firm*—Sughrue, Mion, Zinn, Macpeak & Seas, PLLC

(57) ABSTRACT

In a process for the manufacture of dipped tire cord fabrics made of organic fiber cords, two organic fiber cords before treatment, each formed by subjecting two or more bundles of organic multifilaments to cable twisting and ply twisting, are connected to each other in a particular connection apparatus to form a continuous cord having a joint portion, and a tire cord fabric is made from many organic fiber cords inclusive of the above continuous cord having the joint portion and subjected to a dipping treatment and subsequent heat treatment under particular conditions.

7 Claims, 4 Drawing Sheets

PROCESS FOR THE MANUFACTURE OF A DIPPED TIRE CORD FABRIC MADE OF ORGANIC FIBER CORDS INCLUDING CORD JOINT PORTIONS

BACKGROUND OF THE INVENTION

1. Field of the Invention

This invention relates to a process for the manufacture of a dipped tire cord fabric made of organic fiber cords including cord joint portions, and more particularly to a process for the manufacture of a dipped tire cord fabric made of organic fiber cords, at least one of which cords including a cord joint portion therein. Particularly, the invention relates to a process for the manufacture of a dipped tire cord fabric made of organic fiber cords including cord joint portions and having a high quality wherein the productivity for connecting ends of two cords to each other is excellent, and a size of the joint portion is thinner than the conventional one and becomes approximately equal to a diameter of a non-connected portion of the cord and a tensile strength of the joint portion is high and the fabric is particularly suitable as a reinforcing member for pneumatic tires or conveyor belts.

2. Description of Related Art

The organic fiber cord used as a reinforcing member for the conveyor belt or the pneumatic tire is so-called two or three strand cord formed by subjecting two or more bundles of organic multifilaments to cable twisting and ply twisting. In case of producing this type of the organic fiber cord before dipping, it is unavoidable to vary lengths of the resulting organic fiber cords and also the organic fiber cord having a very long length is sometimes required, so that it is necessary to conduct work or operation of connecting the organic fiber cords to each other.

As general means for connecting the organic fiber cords by hand labor, there is a sewing connection through an electric sewing machine. In such a sewing connection, end portions Ae, Be of two different cords A, B are sewn by means of the electric sewing machine at a state of simply overlapping these end portions with each other as shown in FIG. 5, so that even if the sewing work is conducted more carefully, free end threads not sewn always come out at both ends of a knot portion C between the cords.

These free end threads are required to deliberately cut off from the knot portion by means of scissors or the like. In this case, there is caused a problem that the cords A and B existing in the knot portion are injured or a part of the filaments in these cords is cut off. And also, there is caused an inconvenience that during the manufacture of the tire cord fabric, the free end threads of the knot portion C are caught on other cords adjacent thereto, a dropper pin, a held wire and the like to cause a temporary stop of operation in an apparatus for the manufacture of the tire cord fabric or the cord breaking-up. Furthermore, since the electric sewing machine itself is big, there are caused secondary inconveniences that it is difficult to move the electric sewing machine in a factory having a limited space, and a power feeding cable for the electric sewing machine becomes cumbersome and the like.

In addition to the above means, there is a method of connecting the cords with an apparatus called as a knotter. According to this method, the connecting time required for the completion of, for example, a single joint cord is required to be about five minutes, which is inefficient, and also the untwisting work is required after the connection through the knotter. The latter work tends to depend on the sixth sense and the gist by a skilled worker. Therefore, this method is at variance with the reality.

In order to solve the above problems in the connection between mutual cords, JP-T-6-505,222 discloses a method of connecting ends of two assemblages (cords) wherein an end of one of the assemblages (two or three strand cord) each made of two or more multifilament threads is untwisted to separate the threads at such an end, and an end of the other assemblage is untwisted to separate the threads at such an end likewise the above case, and a pair of these assemblages are placed side by side and also untwisted thread parts in each of the assemblages are placed side by side to obtain junction regions shifted axially from each other, and filaments of the two threads in each junction region are assembled together by air splicing.

Since this connection method need not use the electric sewing machine, the knotter or the like, it is possible to shorten the connecting time and there is not feared the generation of the free end filaments at the knot portion. And also, the junction regions are shifted axially from each other and dispersed in each of the assemblages, so that it is sure to have a merit capable of making the bulge of the knot portion small.

In this method, however, it is necessary that the two or more strand cord is specially separated into the multifilament threads, and such a separation is kept so as not to return it, and the untwisting is carried out every the multifilament thread, and the twisting operation is carried out every the multifilament thread after the completion of the connecting work, so that the method takes labor and requires 2–3 minutes for completing a single joint cord and hence the operability for connecting the cords still stands improvement. For this end, it should be noticed to adopt the connection between the cords as a dipped tire cord fabric made of organic fiber cords without sticking only the connection between the two cords.

SUMMARY OF THE INVENTION

It is, therefore, an object of the invention to provide a process for the manufacture of a dipped tire cord fabric made of organic fiber cords including a joint portion, which is advantageously applicable to articles such as pneumatic tire and conveyor belt, by supposing an initial connection of cords each formed by twisting two or more fiber bundles of organic multifilaments and a finish connection as a tire cord fabric of organic fiber cords wherein the end portions of two cords before the dipping are surely connected in a short time at the initial connection and an excellent quality is given to the tire cord fabric at the finish connection.

According to the invention, there is the provision of a process for the manufacture of a dipped tire cord fabric made of organic fiber cords including cord joint portions, which comprises steps consisting of:

(a) a step that end portions of two organic fiber cords, each formed by subjecting two or more bundles of organic multifilaments to cable twisting and ply twisting, after untwisting prior to a dipping treatment are placed in a box provided in its bottom with a jetting port of a pressure gas and having a circumferential wall and a cover for receiving a jetted gas so as to cross these end portions with each other at a position of the jetting port or in the vicinity of the jetting port together with ends of these end portions, and filaments in the crossed end portions of the two cords are untwisted by jetting the pressure gas through the jetting port into the inside of the box as a jet stream to simultaneously engage these untwisted filaments with each other, whereby an initial connection is completed to form a continued cord; and (b) a step that a tire cord fabric is made from many organic fiber cords including the thus continued cord after the completion of the initial connection, and passed through a dipping solution, and subjected to a heat treatment at a high temperature lower by 10–30° C. than a melting point of the organic multifilament under a given tension to decrease a size of a joint portion in the continued cord to thereby complete a finish connection.

In a preferable embodiment of the invention, the two cords including their free ends are clamped at both side positions sandwiching the box there-between so as to hold the crossing of the two cords in the box, and portions of the two cords near to their ends are cut off in the box or at a position near to the box and then subjected to the initial connection.

In another preferable embodiment of the invention; the pressure gas is a compressed air of 8–11 kgf/cm$^2$.

In the other preferable embodiment of the invention, a connecting length in the initial connection is within a range of 5–15 mm.

In a still further preferable embodiment of the invention, the bundle of organic multifilaments is selected from a nylon fiber bundle, a polyester fiber bundle, a rayon fiber bundle and a Kevlar fiber bundle.

BRIEF DESCRIPTION OF THE DRAWINGS

The invention will be described with reference to the accompanying drawings, wherein.

DESCRIPTION OF THE PREFERRED EMBODIMENTS

Firstly, the connection of two untreated cords will be described with reference to FIGS. 1–3.

Figure 1:
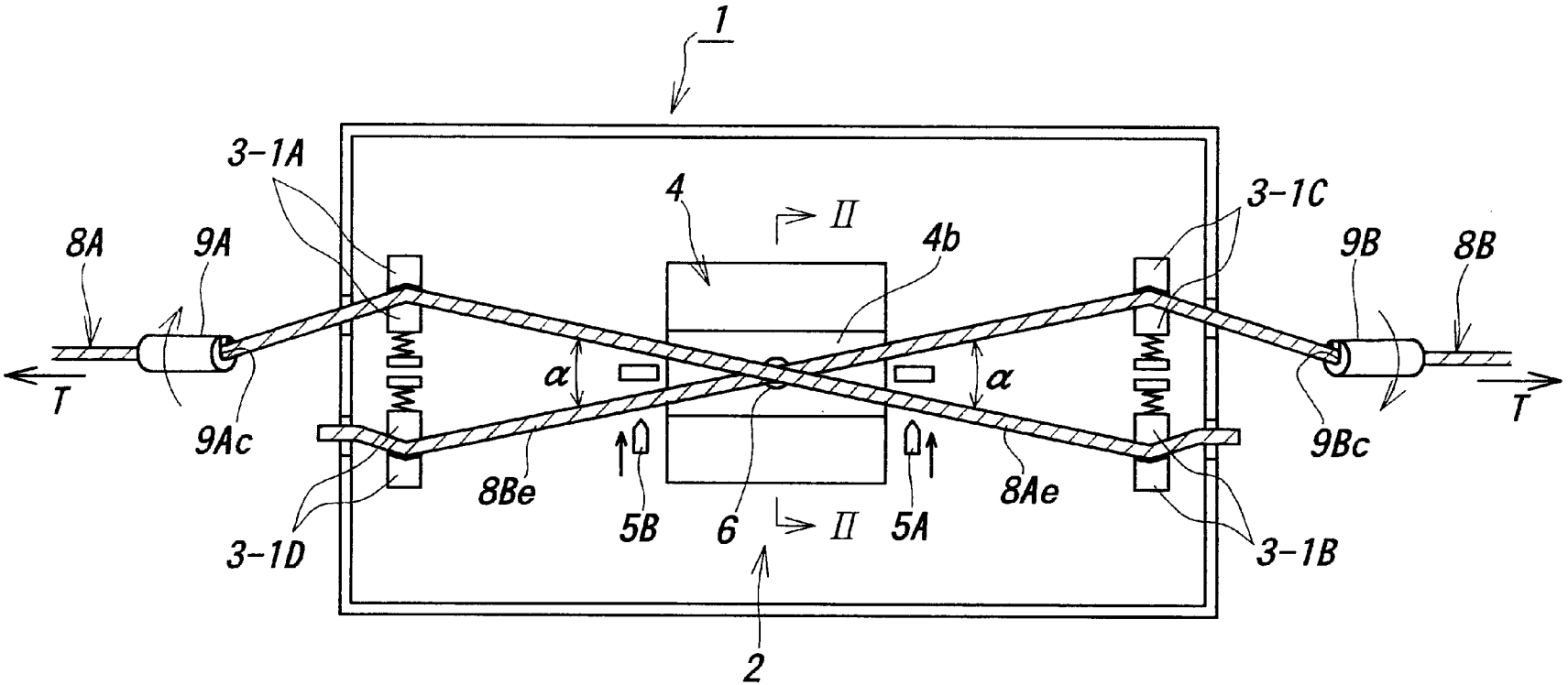
FIG. 1 is a diagrammatically plan view of an outline in an apparatus for connecting two cords according to the invention.

As shown in FIG. 1, a connection apparatus 1 comprises a base 2, four clamping devices 3-1A, 3-1B, 3-1C and 3-1D in total arranged thereon, a cord connecting box 4 showing a side view in FIG. 2 (an outer profile line and a recess portion as mentioned below are shown in FIG. 1), and a pair of cutters 5A and 5B located on both sides of the cord connecting box 4and near thereto.

Each of the clamping devices 3-1A, 3-1B, 3-1C or 3-1D is composed of a first clamp member having a compression coil spring and a second clamp member receiving a pushing force of the first clamp member and is a simple device capable of manually performing the clamping operation. When each of the clamping devices 3-1A, 3-1B, 3-1C or 3-1D is kept at a released state, the first clamp member having the compression coil spring is rendered into a compressed state by hanging on a lock member (not shown). Besides this device, there may be used a clamping device using a small-size double-action cylinder (not shown), wherein the clamping operation and releasing operation can be carried out semi-automatically.

Figure 2:
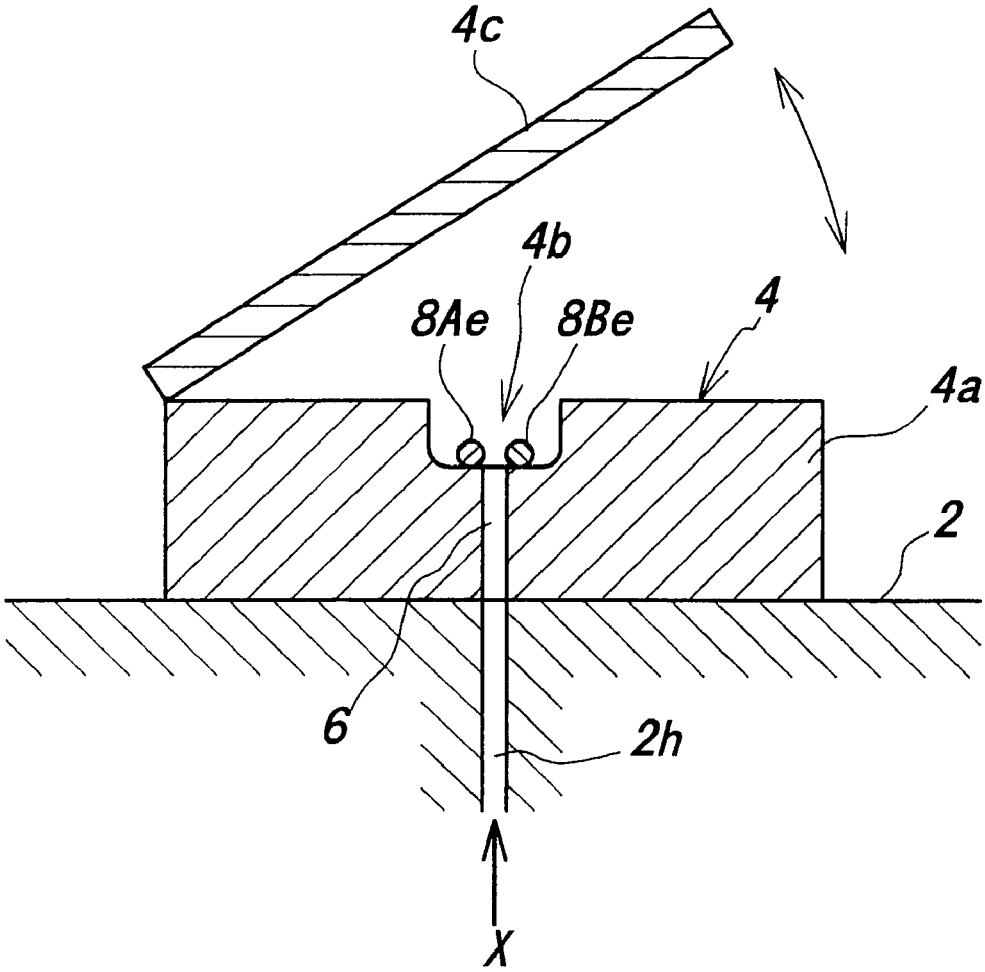
FIG. 2 is a diagrammatically section view taken along a line II—II of FIG. 1.

As shown in FIG. 2, the cord connecting box (hereinafter abbreviated as a box) 4 is provided on a side of a main body 4*a* with a recess portion 4*b* having a space enough to completely accommodate two cords 8A and 8B as mentioned later, and comprises a lid 4*c* connected to the main body 4*a* through a hinge (not shown) and freely moving in a direction shown by an arrow in FIG. 2 and an inlet hole 6 for a pressure gas communicating with a through-hole 2*h* formed in the base 2 of the connection apparatus 1 and opening in a bottom of the recess portion 4*b*. The sectional shape of the inlet hole 6 may be either a circle or an ellipse. The connection between end portions 8Ae and 8Be of the two cords 8A and 8B will be described below.

Firstly, end portions 8A*e* and 8B*e* of two untreated cords 8A, 8B to be connected are fed to the connection apparatus 1. The term "untreated cord" used herein means an organic fiber cord of, for example, 840D/2, 1000D/2, 1260D/2, or 1890D/2 obtained by subjecting a bundle of organic multifilaments having a given denier such as 840D, 1000D, 1260D, or 1890D to cable twisting and then subjecting two or more of such cable twisted bundles to ply twisting. The untreated cord is so-called green cord state before a treatment with a dipping solution as mentioned later and is hereinafter abbreviated as a green cord. As a material of the organic multifilaments, there are nylon-6, nylon-66, polyester, rayon, aramid (Kevlar) and the like.

When the two green cords 8A and 8B are fed to the connection apparatus 1, the end portion 8A*e* of the green cord 8A is passed through a concave portion 9A*c* of an untwisting device 9A, the clamping device 3-1A of the released state and the recess portion 4*b* of the box 4 and is clamped at its end by the clamping device 3-1B, while the end portion 8B*e* of the green cord 8B is passed through a concave portion 9B*c* of an untwisting device 9B, the clamping device 3-1C of the released state and the recess portion 4*b* of the box 4 and is clamped at its end by the clamping device 3-1D.

In this case, the end portions 8A*e* and 8B*e* of two green cords 8A and 8B are crossed with each other at a very small crossing angle $\alpha$ in the recess portion 4*b* of the box 4 to form a flat X-shape, wherein the crossing position is a position of the inlet hole 6 for the pressure gas opening to a bottom of the recess portion 4*b* of the box 4 or in the vicinity thereof. By such a crossing can be conducted the simultaneous cut-off of extra parts of the end portions 8A*e* and 8B*e* of the cords as mentioned later, which contributes to shorten the connection time. The crossing angle $\alpha$ between the end portions 8A*e* and 8B*e* is preferably within a range of 15–45°. After the completion of the above clamping, an initial tension T in the direction shown by an arrow in FIG. 1 is applied to the green cords 8A and 8B, respectively. In this case, the lid 4*c* of the box 4 is naturally at an opened state.

Next, the untwisting devices 9A and 9B are rotated in a direction shown by an arrow (i.e. direction of untwisting the cord) at the crossed state of the end portions 8A*e* and 8B*e*, whereby the twisting of these end portions 8A*e*, 8B*e* is untwisted. The operation of the untwisting devices 9A, 9B may be performed by hand, but it is effective and advantageous to rotate the untwisting devices 9A and 9B by a given number through an electric driving means. In this case, the lid 4*c* of the box 4 may be at either opening or closing state.

After the completion of the untwisting by the given number, the clamping devices 3-1A and 3-1C for the end portions 8A*e* and 8B*e* kept at the released state are actuated to strongly clamp the end portions 8A*e* and 8B*e*. At this state, the cutters 5A and 5B are moved in a direction shown by an arrow by hand or by means of a moving device to cut off an extra end portion existing between the cutter 5A and the clamping device 3-1B and an extra end portion existing between the cutter 5B and the clamping device 3-1D. As a result, cut ends of the cord end portions 8A*e* and 8B*e* subjected to tension Ta larger than the initial tension T by the working of the clamping devices 3-1A and 3-1C are accommodated in the recess portion 4*b* of the box 4.

After the lid 4*c* of the box 4 is closed, the pressure gas such as the compressed air is jetted as a jet stream gas through the through-hole 2*h* formed in the base 2 of the connection apparatus 1 and the inlet hole 6 opening in the bottom of the recess 4*b* of the box 4. The compressed air is favorable to have a pressure of 8–11 kgf/cm$^2$. And also, the jetting time of the jet stream gas is preferable to be within a range of 8–16 seconds.

In this case, the recess portion 4*b* of the box 4 indicates a semi-closed state with the bottom and side wall faces of the box and the lid 4*c,* while only a part of the end portions 8A*e* and 8B*e* at the enter and delivery sides of the recess portion is released into the outside of the box, so that the jet stream gas untwists the bundles of the multifilaments in the cord end portions 8A*e* and 8B*e* accommodated in the recess portion 4*b* of the box 4 inclusive of their free cut ends. At the same time, the jet stream gas strikes against each surface of the recess portion 4*b* under the semi-closed state to form a high-speed turbulence, which engages the untwisted multifilaments of the cord end portions 8A*e* and 8B*e* with each other and finally the end portions 8A*e* and 8B*e* of the cords are strongly connected to each other. The connecting length is substantially determined by the length of the recess portion 4*b* (the length is measured along the left and right direction of FIG. 1), but is practically suitable within a range of 5–15 mm.

As seen from the above, the connection between the end portions 8A*e* and 8B*e* of the green cords 8A and 8B takes only a time of setting the end portions 8A*e* and 8B*e* in the connection apparatus 1, a time of untwisting by the given number, a time of cutting the extra portions through the cutters 5A and 5B, and a time of untwisting and engaging through the pressure gas. Therefore, the connection between the green cords 8A and 8B is not required to take a long time and is about 30 seconds irrespectively of the material of the green cord as previously mentioned, so that the connection productivity between the two cords is considerably excellent as compared with the productivity by the conventional method. In FIG. 3 is shown an embodiment of the joint portion 8C between the green cords 8A and 8B.

Figure 3:
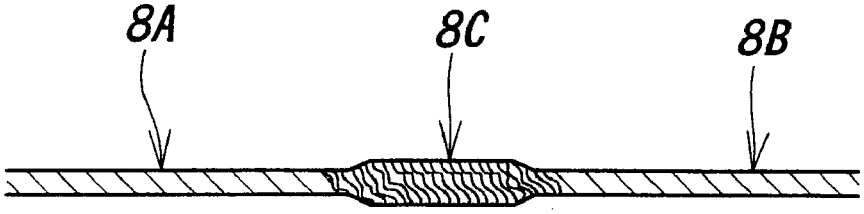
FIG. 3 is a schematic view illustrating a joint portion between two cords prior to a dipping treatment.

In the joint portion 8C shown in FIG. 3, there is observed no filament portions indicating the loosened state corresponding to the free end threads at the knot portion observed in the example using the electric sewing machine. As a result of repetitive investigations whether or not the size of the joint portion 8C forms an obstruction factor in the manufacture of the tire cord fabric inclusive of the cord having the joint portion according to the usual manner, there is found no inconvenience on the manufacture of the tire cord fabric. Furthermore, it has been confirmed that the tensile strength of the joint portion 8C is larger than the tensile strength of the unconnected portion of the cord.

The manufacture of the dipped tire cord fabric made of organic fiber cords inclusive of the above green cord having the joint portion 8C will be described below.

Figure 4:
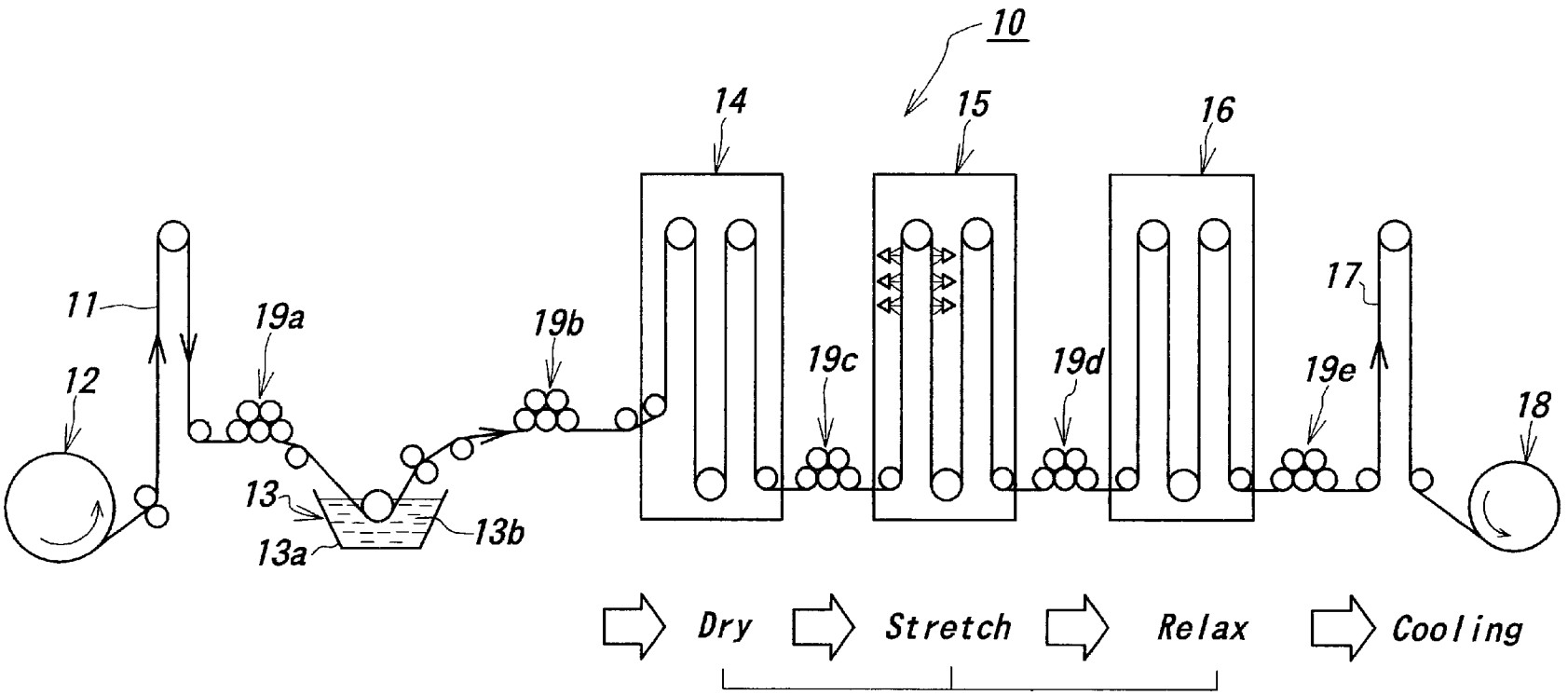
FIG. 4 is a diagrammatically side view of an outline in an apparatus for treating a tire cord fabric made of organic fiber cords.
Figure 5:
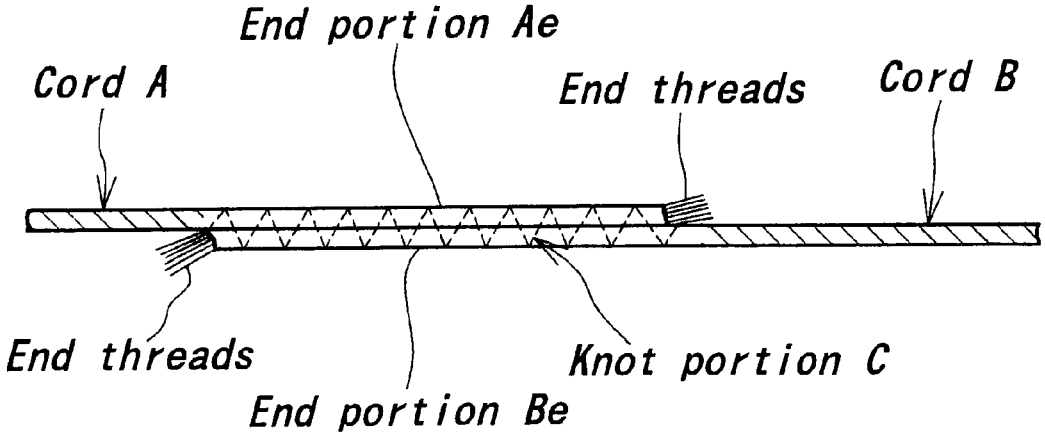
FIG. 5 PRIOR ART
FIG. 5 is a schematic view illustrating a joint portion of two cords by the conventional connection through an electric sewing machine.

In an apparatus 10 for the treatment of a tire cord fabric made of organic fiber cords shown in FIG. 4, an elongated tire cord fabric 11 made of organic green fiber cords inclusive of the green cord having the joint portion 8C is fed out from a take-up motion 12 wound with the elongated tire cord fabric in a direction shown by an arrow, subjected to a dipping treatment by immersing in a dipping solution 13*b* in a tank 13*a* of a dipping device 13 under a guidance of various rolls (shown by circles in FIG. 4), successively passed through a drying zone (dry) 14, a hot-treating zone (heat-stretch) 15 and a hot-relaxing zone (heat-relax) 16, and thereafter cooled to form a finish dipped tire cord fabric 17, which is wound on a take-up reel to obtain a large-size finish wound fabric 18.

In the dipping device 13, the dipping solution is a known mixed solution (RF/L) of resorcin-formaldehyde condensate/rubber latex having an optimum compounding recipe capable of ensuring the adhesion between the organic fiber cord as previously mentioned and rubber. Moreover, a given tension is applied to the tire cord fabric 11 and the dipped tire cord fabric before and after each treatment by pull rolls 19*a,* 19*b,* 19*c,* 19*d,* 19*e* over a region ranging from a position just before the dipping device 13 to a position just before the finish wound fabric 18.

In the dry zone 14, the dipping solution adhered to the tire cord fabric 11 is merely dried by treating at a relatively high temperature under the application of a given tension (although the tension differs by the material of the cord and the denier number, it is usually 1500–4500 gf/cord).

In both the heat-stretch zone 15 and the heat-relax zone 16, the tire cord fabric 11 is subjected to a heat treatment at a temperature lower by 10–30° C., desirably 10–25° C., particularly 10–20° C. than a melting point of the filament of the organic fiber cord under an action of a proper tension (gf/cord). After such a heat treatment at the high temperature under the proper tension, the size of the heat-treated joint portion 8C*t* (not shown) is decreased so as to be approximately equal to a diameter of the unconnected green cord 8A, 8B though the diameter of the joint portion 8C before the heat treatment is about 1.3–1.6 times the diameter of the unconnected green cord 8A, 8B, while the heat-treated joint portion 8C*t* has a tensile strength higher by about 1.2–1.3 times than a tensile strength of the joint portion 8C before the heat treatment.

On the other hand, the heat-treated joint portion 8C*t* has a tensile strength higher by about 0.9–1.1 times and a diameter higher by about 0.9–1.1 times than those of unconnected cord portions 8A*t* and 8B*t* after the above heat treatment. The effect of decreasing the diameter and the effect of increasing the tensile strength through the heat-treated joint portion 8C*t* have been confirmed based on the following examples.

The above effects are clear to be based on the fact that the excellent joint portion 8C can be obtained between the green cords 8A and 8B and the filaments of the organic fiber cord are not melted by the above high-temperature heat treatment but indicate just like a state of adhering these filaments with each other by tackiness just before the melting.

The following examples are given in illustration of the invention and are not intended as limitations thereof.

In Table 1 are shown the material and denier number of the cord, the heating temperature (°C.) every the cord, the tension (gf/cord) applied to the cord, and the heat treating time (sec) as examples. In the material of the cord shown in Table 1, 6N is nylon-6, 66N is nylon-66 and PE is polyester. Moreover, a melting point of nylon-6 filament is 220° C., and a melting point of nylon-66 filament is 250° C., and a melting point of polyester filament is 260° C. Incidentally, a melting point of rayon filament not described in Table 1 is 260 280° C.

TABLE 1

| Cord Denier | | Heat stretch zone | | | Heat relax zone | | |
|---|---|---|---|---|---|---|---|
| Material | Denier | Temperature (° C.) | Tension (gf/cord) | Time (sec.) | Temperature (° C.) | Tension (gf/cord) | Time (sec.) |
| 6N | 840D/2 | 200 | 1500~1700 | 30 | 200 | 800~860 | 30 |
| | 1260D/2 | 200 | 2100~2400 | 35 | 200 | 1100~1200 | 35 |
| | 1890D/2 | 200 | 3400~3700 | 40 | 200 | 2000~2200 | 40 |
| 66N | 840D/2 | 230 | 1400~1600 | 35 | 230 | 700~800 | 35 |
| | 1260D/2 | 230 | 2500~2700 | 35 | 230 | 1300~1500 | 35 |
| | 1890D/2 | 230 | 4300~4500 | 35 | 230 | 2600~2800 | 35 |
| PE | 1000D/2 | 250 | 1700~2300 | 60 | 250 | 800~1000 | 60 |
| | 1500D/2 | 250 | 2400~2700 | 60 | 250 | 900~1200 | 60 |

As to a heat-treated joint portion 8C*t* between cords 8A*t* and 8B*t* sampled from a finish wound fabric 18 treated under the temperature, tension and treating time disclosed in the columns of "heat-stretch zone" and "heat-relax zone" of Table 1, there are obtained the tensile strength and diameter as previously mentioned. As seen from the above, the diameter of the heat-treated joint portion 8C*t* is not so increased in the finish wound fabric 18 including the heat-treated joint portion 8C*t*, so that the end count (number of cords per unit width as measured in a direction perpendicular to the cord extending direction) can be made sufficiently large. And also, the heat-treated joint portion 8C*t* has a sufficient strength. Therefore, such a finish wound fabric has a satisfactory quality as a reinforcing member for the pneumatic tire or belt conveyor.

According to the invention, the organic fiber cords before the treatment can be connected to each other in a short time, and the tire cord fabric can be manufactured by using the cord having such a joint portion together with the other organic fiber cords without causing inconveniences, and the joint portion has substantially the same diameter and tensile strength as those of the unconnected cord portion when the resulting tire cord fabric is subjected to a dipping treatment and subsequent high-temperatured heat treatment under a given tension, so that there can be provided a process for the manufacture of the tire cord fabric including the joint portions and possessing both high productivity and high quality.

What is claimed is:

1. A process for the manufacture of a cord comprising organic fiber cords linked through cord joint portions, wherein said organic fiber cords comprise two or more bundles of organic multifilaments that have been subjected to cable twisting and ply twisting, said process comprising:

untwisting the end portions of two organic fiber cords;

placing said end portions in a box, wherein said box has provided in its bottom a jetting port for jetting a pressurized gas, a circumferential wall and a cover for receiving a jetted gas, and wherein the end portions are placed in the box so as to cross the end portions with each other at the position of the jetting port or in the vicinity of the jetting port;

untwisting the filaments in the crossed end portions of the two cords by jetting pressurized gas through the jetting port into the inside of the box as a jet stream and simultaneously engaging the untwisted filaments with each other, whereby an initial connection is completed to form a continued cord;

passing the continued cord through a dipping solution; and subjecting the dipped continued cord to heat treatment under tension at temperature of 10 to 30° C. lower than a melting point of the organic multifilament to decrease a size of a joint portion in the continued cord.

2. The process according to claim 1, wherein the two cords including their free ends are clamped at both side positions sandwiching the box therebetween so as to hold the crossing of the two cords in the box, and portions of the two cords near to their ends are cut off in the box or at a position near to the box and then subjected to the initial connection.

3. The process according to claim 1, wherein the pressurized gas is compressed air of 8–11 kgf/cm$^2$.

4. The process according to claim 1, wherein a connecting length in the initial connection is within a range of 5–15 mm.

5. The process according to claim 1, wherein each bundle of organic multifilaments is selected from the group consisting of a nylon fiber bundle, a polyester fiber bundle, a rayon fiber bundle and a Kevlar fiber bundle.

6. The process for the manufacture of a cord as claimed in claim 1, wherein the end portions are placed in the box so as to cross the end portions at a crossing angle $\alpha$ of from 15 to 45°.

7. The process for the manufacture of a cord as claimed in claim 1, wherein the jetting time of said jet stream is from 8 to 16 seconds.

* * * * *